US010273124B2

(12) United States Patent
Rutherford

(10) Patent No.: US 10,273,124 B2
(45) Date of Patent: Apr. 30, 2019

(54) ROTATION CONTROL SYSTEM FOR MATERIAL HANDLING MACHINES

(71) Applicant: Caterpillar Inc., Peoria, IL (US)

(72) Inventor: Stephen Platt Rutherford, Edwards, IL (US)

(73) Assignee: Caterpillar Inc., Deerfield, IL (US)

( * ) Notice: Subject to any disclaimer, the term of this patent is extended or adjusted under 35 U.S.C. 154(b) by 53 days.

(21) Appl. No.: 15/380,697

(22) Filed: Dec. 15, 2016

(65) Prior Publication Data

US 2018/0170722 A1 Jun. 21, 2018

(51) Int. Cl.

| | |
|---|---|
| ***B66C 1/58*** | (2006.01) |
| ***B66C 3/00*** | (2006.01) |
| ***B66C 23/86*** | (2006.01) |
| ***E02F 3/413*** | (2006.01) |
| ***B66C 13/08*** | (2006.01) |
| ***E02F 9/20*** | (2006.01) |

(52) U.S. Cl.

CPC ..... *B66C 23/86* (2013.01); *B66C 1/585* (2013.01); *B66C 3/005* (2013.01); *B66C 13/08* (2013.01); *E02F 3/4135* (2013.01); *E02F 9/2037* (2013.01); *E02F 9/2004* (2013.01)

(58) Field of Classification Search

CPC ..... B66C 23/86; B66C 23/36; B66C 23/54; B66C 1/44; B66C 13/08; B66C 13/18; E02F 9/123; E02F 9/2004; E02F 3/4135

See application file for complete search history.

(56) References Cited

U.S. PATENT DOCUMENTS 4,130,168 A * 12/1978 Deike ..... E21B 7/022 173/141
6,343,981 B1 * 2/2002 Buchanan ..... E04G 23/006 156/763
6,751,896 B2 * 6/2004 Underwood ..... E02F 3/964 37/403
6,826,452 B1 * 11/2004 Holland ..... B66C 1/663 318/566

(Continued)

FOREIGN PATENT DOCUMENTS

GB 2467149 7/2010
JP H1087269 4/1998

(Continued)

*Primary Examiner* — Behrang Badii
*Assistant Examiner* — Daniel L Greene
(74) *Attorney, Agent, or Firm* — Finnegan, Henderson, Farabow, Garrett & Dunner, LLP

(57) ABSTRACT

A rotation control system may be provided for a material handling machine. The rotation control system may include a boom and a work tool attached to the boom. A swing motor may be capable of swinging the boom and the work tool. A work tool motor may be capable of rotating the work tool relative to the boom. An input device may generate a first signal indicative of a desired swinging of the boom and a second signal indicative of a desired rotation of the work tool. A controller may be in communication with the input device, the swing motor, and the work tool motor. The controller may be capable of actuating the work tool motor based only on the second signal during a first mode of operation and may be capable of actuating the work tool motor based on swinging of the boom during a second mode of operation.

20 Claims, 4 Drawing Sheets

(56) References Cited

U.S. PATENT DOCUMENTS 7,117,618 B2 * 10/2006 Underwood ..... E02F 3/964 37/403
7,497,492 B2 3/2009 Gonzalez et al.
7,607,643 B1 * 10/2009 Box ..... B66D 3/04 254/323
7,850,025 B2 12/2010 Neupert et al.
8,061,764 B2 * 11/2011 Meier ..... B62D 33/0617 180/89.14
2004/0045289 A1 * 3/2004 Ikeda ..... E02F 3/384 60/469
2005/0102866 A1 * 5/2005 Sewell ..... E02F 3/325 37/411
2009/0218112 A1 * 9/2009 Mintah ..... E02F 3/434 172/1
2009/0265047 A1 * 10/2009 Mintah ..... E02F 3/435 701/1
2009/0282710 A1 * 11/2009 Johnson ..... E02F 3/3677 37/406
2009/0293322 A1 * 12/2009 Faivre ..... G05D 1/0891 37/348
2013/0000290 A1 * 1/2013 Zhang ..... F15B 21/14 60/327
2013/0166156 A1 * 6/2013 Stanek ..... E02F 3/435 701/50
2014/0060025 A1 * 3/2014 Cesur ..... F15B 21/08 60/327
2014/0067092 A1 * 3/2014 Cesur ..... E02F 9/2025 700/83
2014/0091612 A1 * 4/2014 Rowher ..... E21C 27/24 299/10
2014/0290102 A1 * 10/2014 O'Donnell ..... E02F 3/435 37/403
2015/0344271 A1 12/2015 Schneider et al.
2016/0244950 A1 * 8/2016 Kami ..... E02F 9/2033
2016/0257533 A1 9/2016 Jamieson

FOREIGN PATENT DOCUMENTS

JP 2013035651 2/2013
JP H5254115 8/2013

* cited by examiner

ROTATION CONTROL SYSTEM FOR MATERIAL HANDLING MACHINES

TECHNICAL FIELD

The present disclosure relates generally to a material handling machine, and more particularly, to a system and method for controlling the rotation of the material handling machine.

BACKGROUND

Machines, such as material handlers, typically include a frame of some type, a boom mounted to the frame, and a work tool mounted to an end of the boom. The frame of a material handling machine is typically configured to swing relative to an undercarriage via an electric or hydraulic actuator, such as a swing motor. The boom may further be configured to raise and lower relative to the frame via one or more additional hydraulic actuators. Specialized material handling tools, such as a grapple, may open, close, and be caused to rotate relative to the boom via additional linear actuators, swing motors, and/or geared mechanisms. When the frame swings relative to the undercarriage, the boom and grapple are also caused to swing.

During the swinging motion of the frame, the material load held by the grapple changes orientation relative to the undercarriage. In some instances, such as when handling elongated material loads, this change in orientation is not desired. For example, in the logging industry, logs may be stacked in a parallel orientation relative to a loading container, a railroad car, or a barge. When the logs are subsequently loaded into or on top of the loading container, the material handling machine may perform three steps. First, the machine may use the grapple to pick up the logs. Second, the machine may swing the logs over the loading container. When the logs are originally aligned with the loading container, the swinging motion necessarily causes the logs to rotate out of alignment with the loading container. Accordingly, the machine must then rotate the logs during a third step in order to re-align the logs with the loading container. After realignment, the logs may be lowered and/or released. The re-alignment step decreases productivity and efficiency, particularly when handling bulk quantities of elongated materials. Furthermore, the re-alignment step may also increase collision risks.

One way to avoid the extra re-alignment step is for an operator to manually cause the frame and boom to rotate in a first direction, while simultaneously manually controlling the work tool to counter rotate in a second direction. While possible, this method requires skill and constant operator attention. Further, it can be prone to operator error and/or lead to operator fatigue.

Another rotation method is described in JP2013035651, ("the '651 disclosure"). The '651 disclosure describes a rotating tool and device for turning a suspended load. The '651 disclosure may be useful for rotating suspending loads during a swinging movement of a tower crane boom. The rotating tool may rotate a load that is suspended by a hoist, crane, or a rope. The rotating tool includes an upper hanging connection, a tool frame, a rotation motor, a locking portion, and a lower rotating connection. The lower rotating connection is connected to the rotation motor. In turn, the rotation motor is configured to rotate the lower rotating connection based on operator inputs. Operator inputs may be received by a controller, for example, via a remote operator interface which can then automatically adjust the acceleration and turning speed of the lower rotatable connection in order to stabilize the load.

Although the rotation system of the '651 disclosure may be advantageous for stabilizing rotation of a suspended load, the system still suffers from one or more of the problems described above. For example, the '651 disclosure still requires constant operator attention, which can lead to operator error and/or fatigue.

The disclosed material handling system is directed to overcoming one or more of the problems set forth above.

SUMMARY

One aspect of the present disclosure is directed to a rotation control system. The rotation control system may include a boom and a work tool attached to the boom. The rotation control system may also include a swing motor that may be capable of swinging the boom and the work tool. The rotation control system may additionally include a work tool motor capable of rotating the work tool relative to the boom. The rotation control system may further include one or more input devices may generate a first signal indicative of a desired swinging of the boom and a second signal indicative of a desired rotation of the work tool and a controller in communication with the input device or devices, the swing motor, and the work tool motor. The controller may be capable of actuating the work tool motor based only on the second signal during a first mode of operation and may also be capable of actuating the work tool motor based on swinging of the boom during a second mode of operation.

Another aspect of the present disclosure is directed to a method of operating a rotation control system. The method may include receiving a first signal indicative of swinging of a boom and receiving a second signal indicative of a desire to move a work tool connected to the boom. The control method may also include controlling rotation of the work tool based on only the second signal during a first mode of operation, and control rotation of the work tool based on the first signal during a second mode of operation.

Another aspect of the present disclosure is directed to a rotation control system for a material handling machine. The rotation control system may include an undercarriage and a frame rotatably connected to the undercarriage having an operator station mounted to the frame. The rotation control system may also include a boom operably attached to the frame and capable of pivoting vertically. The rotation control system may additionally include a swing motor configured to swing the frame and boom relative to the undercarriage, a work tool rotatably coupled to the boom, and a work tool motor configured to rotate the work tool. The rotation control system may further include at least one input device capable of generating a first signal indicative of a desired swinging of the frame and boom, a second signal indicative of a desired rotation of the work tool, and a controller in communication with the at least one input device, the swing motor, and the work tool motor. The controller may be capable of actuating the work tool motor based only on the second signal during a first mode of operation, capable of actuating the work tool motor based on swinging of the boom during a second mode of operation, and capable of actuating the work tool motor based on a rotation ratio during a third mode of operation.

DETAILED DESCRIPTION

Figure 1:
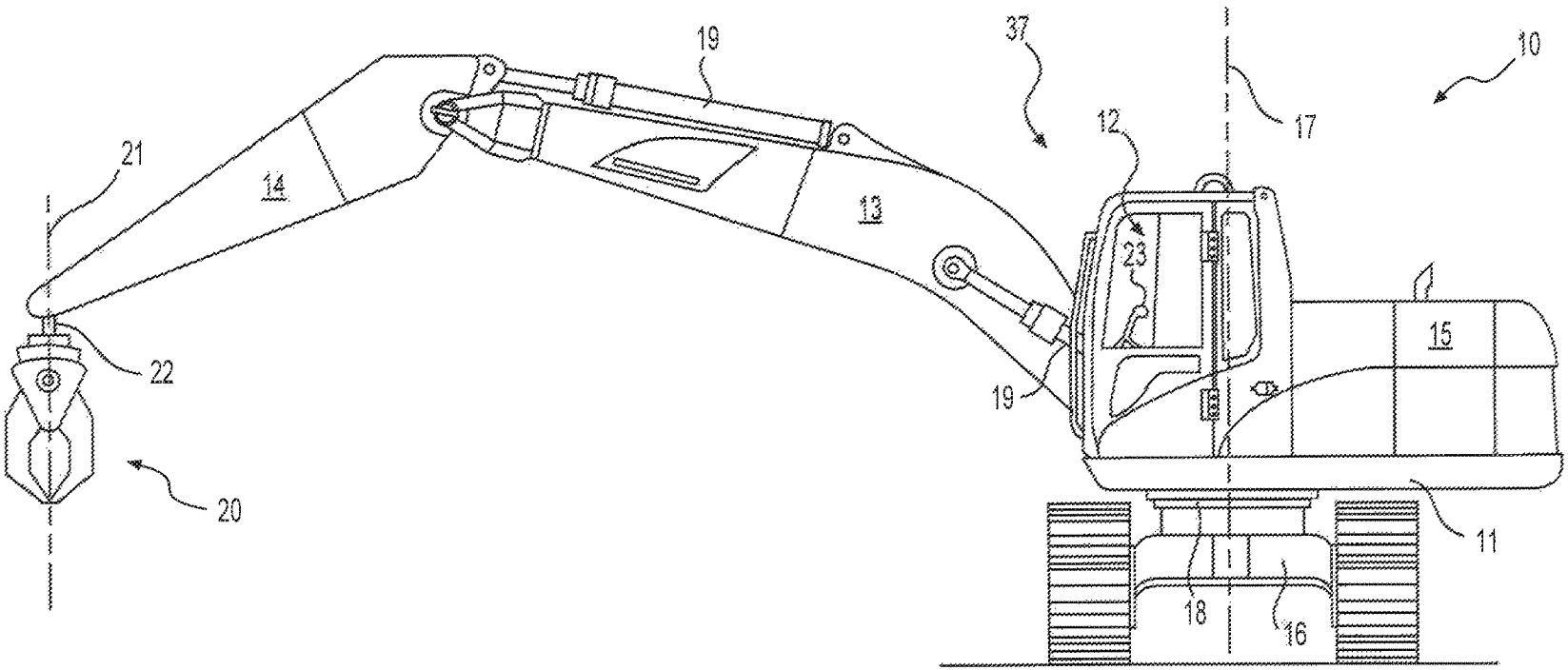
FIG. 1 is a side-view diagrammatic illustration of an exemplary material handling machine.

FIG. 1 illustrates an exemplary machine 10 having multiple systems and components that cooperate to accomplish a task. Machine 10 may be a fixed or mobile machine that performs some type of operation associated with an industry, such as logging, mining, etc. Machine 10 may be a material handler such as, for example, a mobile crane, a tower crane, an excavator, or a logging skidder. For the purpose of this disclosure, a material handler may be considered a machine that primarily loads and/or unloads material of any size, shape, and type.

As a material handler, machine 10 may include a frame 11, an operator station 12, a boom 13, a stick 14, and/or other similarly situated linkage members. Machine 10 may also include a power source 15 configured to power the numerous components of machine 10. Frame 11 may be operably coupled to an undercarriage 16 and configured to swing (rotate) about a vertical swing axis 17 with the assistance of an electric or hydraulic swing motor 18. Boom 13 and/or stick 14 may be connected to swing with frame 11 and may also be configured to pivot vertically with the assistance of one or more electric or hydraulic linear actuators 19. Work tool 20 may be connected to an end of stick 14 and configured to rotate about a work tool axis 21 with the assistance of an electric or hydraulic work tool motor 22.

In the disclosed embodiment, work tool axis 21 is substantially vertical and generally parallel with swing axis 17. However, it is contemplated that work tool 20 may be tiltable, (i.e., capable of pivoting). In those embodiments, work tool axis 21 could become non-parallel relative to swing axis 17. Moreover, work tool 20 may rotate about work tool axis 21 irrespective of the orientation of swing axis 17.

During a swinging motion, swing motor 18 may cause frame 11 to rotate about swing axis 17, thereby also causing boom 13 and work tool 20 to rotate. Similarly, the extension and retraction of linear actuators 19 may function to assist in raising and lowering work tool 20, by raising and lowering boom 13 and/or stick 14. Work tool motor 22 may rotate work tool 20 relative to boom 13 and stick 14 to counteract or complement motion caused by swing motor 18.

Each of linear actuators 19 may commonly be hydraulic cylinders that may include a tube and a piston assembly (not shown) arranged to form two separated pressure chambers. The pressure chambers may be selectively supplied with pressurized fluid and drained of the pressurized fluid to cause the piston assembly to displace within the tube, thereby changing an effective length of linear actuators 19. Swing motor 18 and/or work tool motor 22 may operate similarly to linear actuators 19 with the addition of being capable of rotation.

Work tool 20 may be any type of work tool capable of rotation with the assistance of work tool motor 22. Exemplary work tools may include a grapple, a rotatable bucket, a fork arrangement, etc. In some embodiments, work tool 20 may additionally be pivoted forward and backward relative to boom 13 by a pivot actuator (not shown). Numerous different work tools 20 may be attachable to a single machine 10 and controllable via an operator interface device 23.

Power source 15 may be mounted to frame 11 and embody an engine such as, for example, a diesel engine, a gasoline engine, a gaseous fuel-powered engine, or any other type of combustion engine known in the art. It is additionally contemplated that power source 15 may alternatively be a non-combustion source of power such as a fuel cell, a power storage device, an electrical input, or another power source known in the art. Power source 15 may produce mechanical and/or electrical power outputs for controlling the numerous components of machine 10. For example, power source 15 may be converted to mechanical power for moving linear actuators 19, work tool motor 22, and swing motor 18.

The movement of machine 10 and its components may be controlled from operator station 12, which can be mounted to frame 11. Operator station 12 may be configured as a viewing location for a machine operator to view a worksite and control motion of machine 10 via operator interface device 23. In some embodiments, machine 10 may include a plurality of operator interface devices 23. Specifically, operator station 12 may include one or more operator interface devices 23 embodied as single or multi-axis joysticks located proximal an operator seat (not illustrated). For example, separate operator interface devices 23 may be included to control a frame swinging, a boom pivot, a stick pivot, and/or a work tool rotation.

Figure 2:
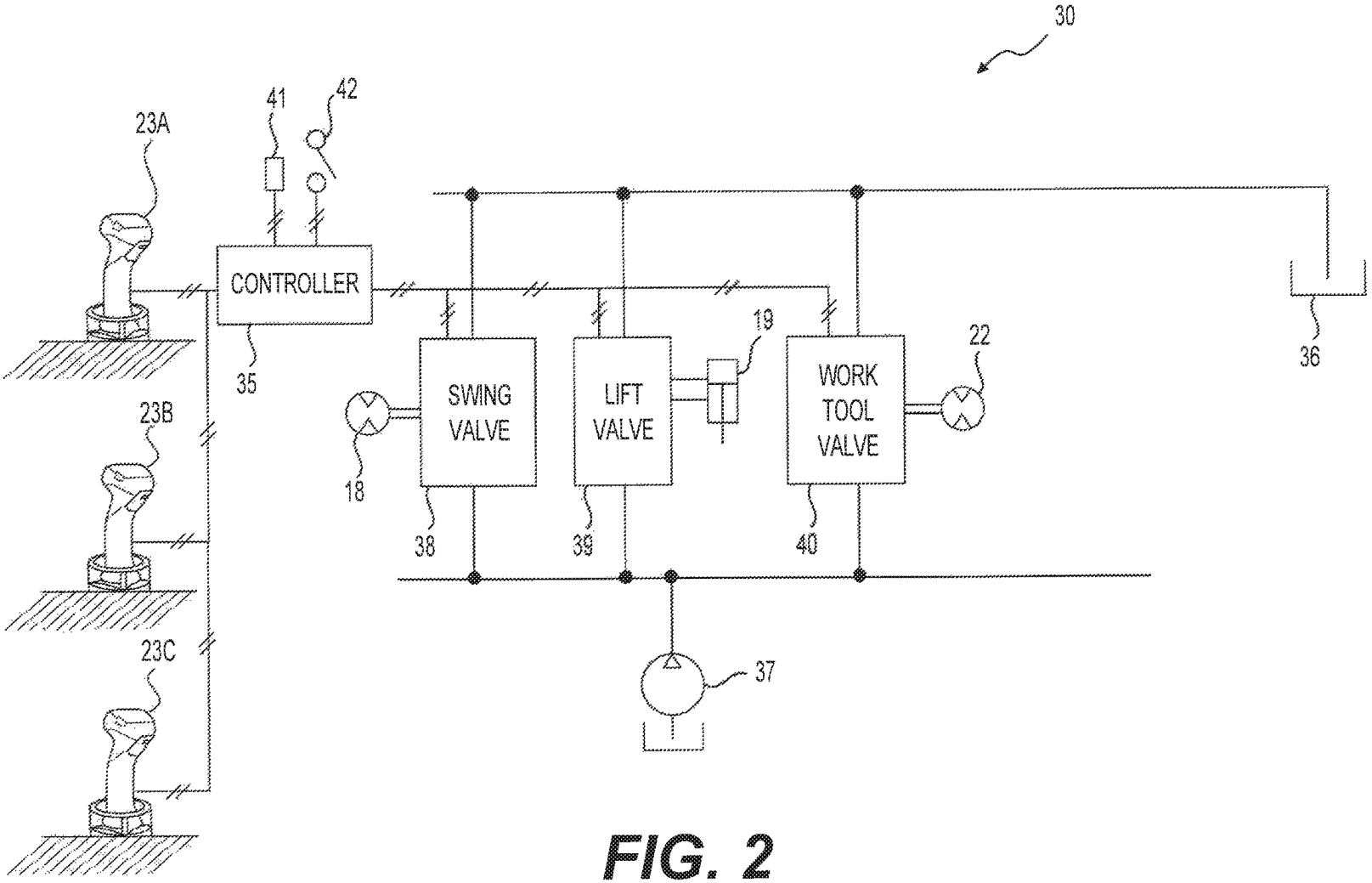
FIG. 2 is a schematic illustration of an exemplary rotation control system that may be used with the machine of FIG. 1.

FIG. 2 shows an exemplary rotation control system 30 that may be used with machine 10 of FIG. 1. Rotation control system 30 may control movements of machine 10 based on inputs received from operator interface devices 23. Operator interface devices 23 may receive input from a machine operator indicative of a desired work tool, boom, stick, and/or frame movement, and responsively generate corresponding output signals directed to a controller 35. For example, a first interface device 23A may be used to control a swinging movement of frame 11 about swing axis 17; a second interface device 23B may be used to control lifting/lowering of boom 13 and/or stick 14; and a third operator interface device 23C may be used to control rotation of work tool 20 about work tool axis 21. It is contemplated, however, that a different number of operator interface devices 23 (i.e., a single multi-axis joystick) could be used to control these functions if desired.

As shown in FIG. 2, controller 35 may affect the swinging, lifting, and pivoting movements based on the input received from operator interface devices 23A, 23B, and 23C by regulating fluid flows to swing motor 18, linear actuators 19, and work tool motor 22. In particular, swing motor 18, linear actuators 19, and work tool motor 22 may be part of a hydraulic circuit that also includes a tank 36, a pump 37, and at least one valve (i.e., a swing valve 38, a lift valve 39, and a work tool valve 40) associated with each of swing motor 18, linear actuators 19, and work tool motor 22. Pump 37 may draw fluid from tank 36, pressurize the fluid, and pass the fluid though swing valve 38, lift valve 39, and work tool valve 40 to swing motor 18, linear actuators 19, and work tool motor 22, respectively.

Controller 35 may selectively cause valves 38-40 to pass varying amounts of the pressurized fluid in particular directions through the corresponding actuators such that the actuators move in desired directions, with desired speeds, and or with desired forces. After passing through valves 38-40, and/or the corresponding actuators, the fluid may be drained back to tank 36. Accordingly, to provide for the operator desired movement of machine 10, controller 35 may selectively cause movement of the corresponding valve in an amount corresponding to the inputs received via operator interface devices 23.

Controller 35 may include a single microprocessor or multiple microprocessors that include a means for controlling an operation of rotation control system 30. Numerous commercially available microprocessors can be configured to perform the functions of controller 35. It should be appreciated that controller 35 could readily be embodied in a general machine microprocessor capable of controlling numerous machine functions. Controller 35 may include a memory, a secondary storage device, a processor, and any other components for running an application. Various other circuits may be associated with controller 35 such as power supply circuitry, signal conditioning circuitry, solenoid driver circuitry, and other types of circuitry.

In some embodiments, controller 35 may be configured to automatically control movement of a particular actuator simultaneously with a manually generated control input of another actuator. For example, controller 35 may automatically control a work tool rotation based on a manually generated control input intended to cause a frame swinging movement. There may be several ways to accomplish this.

One way to control work tool rotation may be based directly on manual input, when operating in a semi-automatic mode. For example, an operator may move operator interface device 23 to request the frame swinging motion. Based on the signal from operator interface device 23, controller 35 may automatically generate a similar signal directed to valve 40 to cause work tool rotation.

Another way to control work tool rotation may be based on sensed movement of frame 11 and/or boom 13. For example, a sensor 41 may be provided that generates signals indicative of requested mechanical movement of frame 11 and/or an actual mechanical movement of swing valve 38. Sensor 41 may be configured to directly detect a swing angle of frame 11 and/or boom 13 during a rotation caused by swing motor 18. In particular, sensor 41 may be a rotary encoder associated with a pivot point of frame 11 that sends a signal indicative of an angular rotation of frame 11 relative to swing axis 17 to controller 35. Sensor 41 may be coupled to a rotation shaft, a gear mechanism, or any other similarly situated rotatable member of machine 10 to provide the signal indicative of frame 11 and boom 13 rotation. Alternatively, sensor 41 may be configured to detect a position of swing valve 38 and/or swing motor 18 during frame rotation.

Controller 35 may process the signals from any exemplary sensor 41 to determine the particular angular speed, acceleration, direction, and/or position of boom 13. For example, controller 35 may process the signals into a first dataset that represents the particular angular speed, acceleration, direction, and/or position of boom 13 by utilizing one or more data maps relating to the specific kinematics of machine 10 and particularly boom 13. Controller 35 may also process the first dataset into a second dataset corresponding to a desired angular speed, acceleration, direction, and/or position of work tool 20 based on the the first dataset. For example, controller 35 may process the first dataset into the second dataset by utilizing one or more data maps relating to the specific kinematics of machine 10 and particularly work tool 20. In some embodiments, the scale of the second dataset parameters may relate to the scale of the first dataset parameters with the notable exception that the second dataset parameters are opposing parameters of equal amounts (i.e. an angular speed, acceleration, direction etc. of work tool 20 are opposite of an angular speed, acceleration, direction etc. of boom 13).

Controller 35 may synchronize the rotation of work tool 20 with the swinging of frame 11 and/or boom 13 based on the signals of sensor 41, but only when controller 35 is operating in the semi-autonomous mode of operation. For example, a machine operator may toggle a switch 42 that sets controller 35 in the semi-autonomous mode of operation, during which synchronization of the rotation of work tool 20 and swinging of boom 13 are desired.

Conversely, the operator may toggle switch 42 to set controller 35 into a manual mode of operation, in which synchronization is not desired. When operating in the manual mode, controller 35 may regulate valves 38-40 independently based on only corresponding inputs received from the separate operator interface devices 23.

Figure 3:
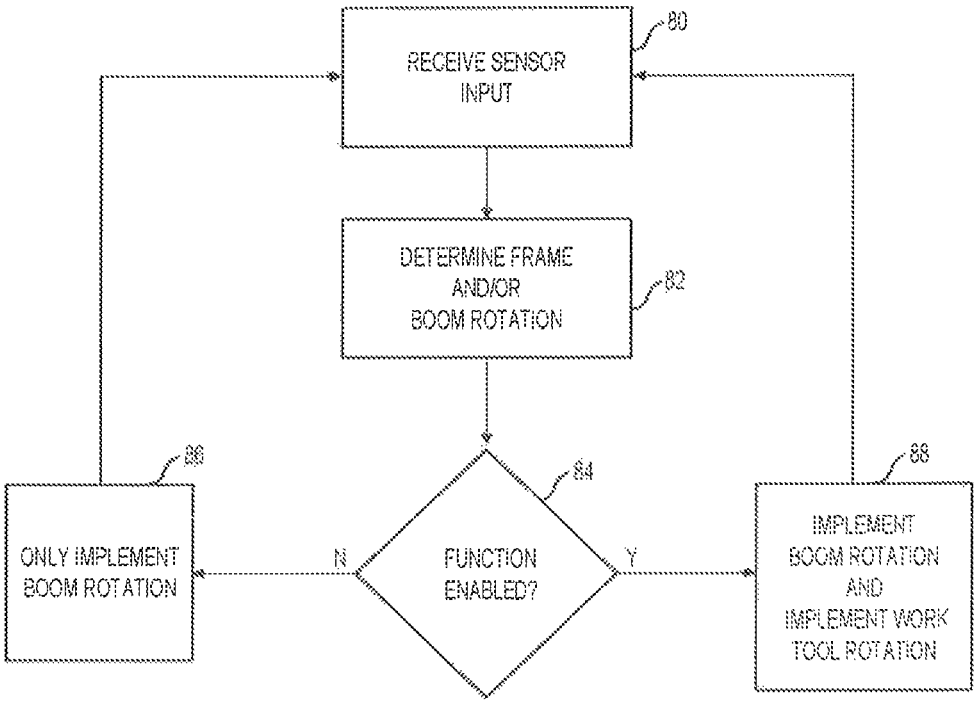
FIG. 3 is a flow chart illustrating an exemplary disclosed method of operating the rotation control system of FIG. 2.
Figure 4B:
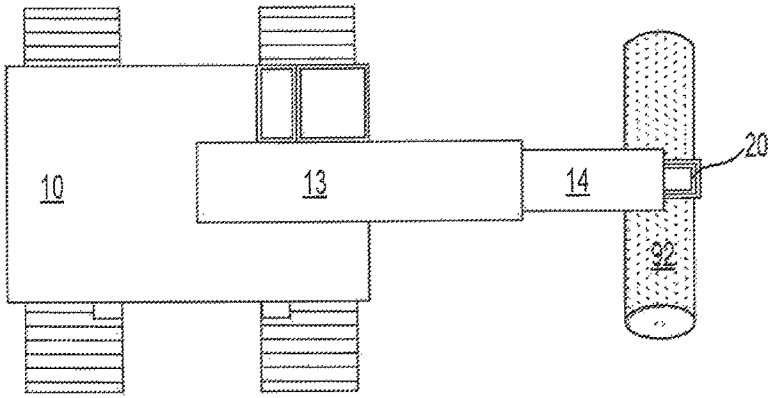
FIG. 4B is an illustration of the material handling machine of FIG. 1 executing a swinging motion with a first mode of operation enabled.
Figure 4C:
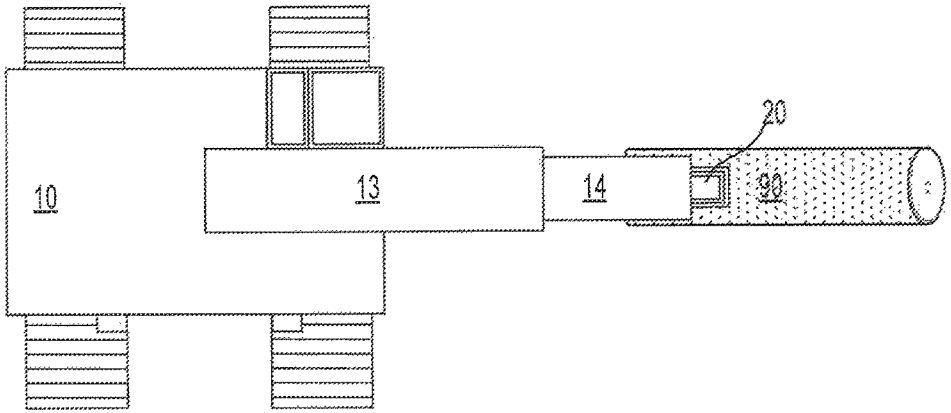
FIG. 4C is an illustration of the material handling machine of FIG. 1 executing a swinging motion with a second mode of operation enabled.
Figure 4A:
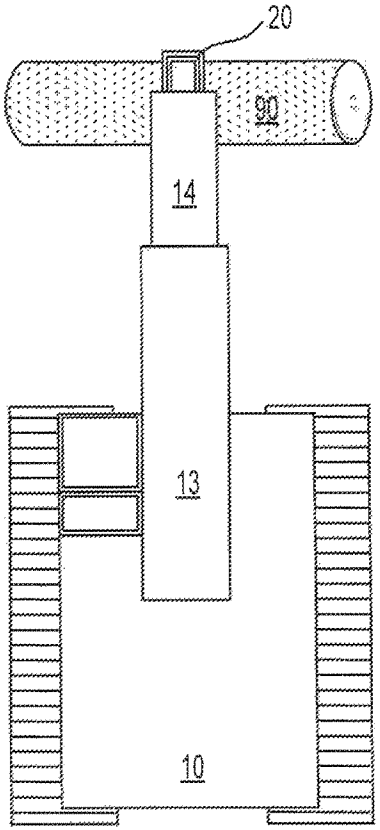
FIG. 4A is an illustration of the material handling machine of FIG. 1 before commencing a swinging motion.

FIG. 3 illustrates an exemplary method of operating rotation control system 30 of FIG. 2. FIG. 4A illustrates the machine 10 of FIG. 1 with an originally oriented material load before commencing a swinging motion. FIG. 4B illustrates the machine 10 of FIG. 1 executing a swinging motion with a first mode of operation, which causes a material load to change orientation. FIG. 4C illustrates the machine 10 of FIG. 1 executing a swinging motion during a second mode of operation, which enables the original orientation of the material load to be maintained during the swinging motion. Detailed descriptions of FIGS. 3 and 4A-4C will be provided in the following section to further illustrate the concepts of this disclosure.

INDUSTRIAL APPLICABILITY

The disclosed rotation control system may be applicable to any machine where synchronizing a frame swinging motion with a work tool rotation is desirable. The disclosed rotation control system may improve efficiency by automatically controlling a rotation of the work tool during the frame swinging motion, such that a desired orientation of the material load is maintained throughout the swinging motion. Operation of rotation control system 30 will now be explained with reference to FIGS. 3 and 4A-4C.

As shown by FIG. 3, the process may begin when controller 35 receives an input indicative of a frame 11 and/or boom 13 swinging motion (Step 80). As described above, this input may include the signal from operator interface device 23A requesting the swinging movement, and/or the signal from sensor 41 indicative of the movement actually occurring. FIG. 4A is a top down view of machine 10 at a time when controller 35 receives an input requesting clockwise rotation of boom 13 and/or an input indicative of an actual.

The actual rotation of frame 11 and/or boom 13 may be determined by controller 35 based on the received inputs (Step 82). For example, controller 35 may reference one or more maps, equations, graphs, and/or algorithms stored in memory that relate the received signals to the desired and/or actual movement of frame 11 and/or boom 13.

Controller 35 may then respond in one of two ways, depending on the current mode of operation. Specifically, controller 35 may operate in the semi-autonomous mode or in the manual mode, and operation in these modes may be dependent on the position of switch 42. For example, controller 35 may determine the position of switch 42 (Step 84) and thereby deduce whether the functionality is enabled (Step 84).

If the semi-autonomous functionality is disabled (Step 84: No), controller 35 will cause only a boom rotation to occur based on the input (Step 86). That is, when not enabled, work tool rotation will only be caused based on a direct request for such rotation received via operator interface device 23C. When operating in the manual mode of operation, the input signals from sensor 41 may be ignored. FIG. 4B is a top down view of machine 10 operating in the manual mode of operation after controller 35 has implemented only a boom 13 rotation. As can be seen from FIG. 4B, originally oriented material 90 changes orientation during swinging of frame 11 to alternately oriented material 92.

However, when the semi-autonomous function is enabled (Step 84: Yes), controller 35 may cause work tool 20 rotation to simultaneously occur without requiring additional input from interface device 23C (Step 88). In particular, controller 35 may correlate a desired or actual boom 13 rotation to a corresponding desired work tool 20 rotation. For example, controller 35 may establish necessary positions, angles, and/or velocities for work tool motor 22 (e.g. via appropriate movements of work tool valve 40) to cause work tool 20 to rotate in an opposite direction and at about the same rate as frame 11 and/or boom 13. FIG. 4C is a top down view of machine 10 operating in the semi-autonomous mode of operation after controller 35 has implemented a boom 13 rotation and a corresponding simultaneous work tool 20 rotation. Comparison of FIG. 4A to FIG. 4C shows that the work tool 20 has rotated in the opposite direction of boom 13 and at the same rate of rotation, such that the originally oriented material 90 is maintained throughout the swinging motion.

It is contemplated that, in other embodiments, rotation control system 30 may have a third mode of operation similar to the semi-autonomous mode of operation described above. In the third mode of operation, controller 35 may scale the rotation of work tool 20 with the rotation of frame 11 and/or boom 13 according to any desired rotation ratio (i.e., instead of a 1:1 ratio). The rotation ratio may generally be understood as a ratio of angular speed, acceleration, direction, and/or position of work tool 20 relative to frame 11. For example, controller 35 may cause work tool 20 to rotate more slowly than the rotation of boom 13 during a particular swinging movement. Alternatively, controller 35 may scale the rotation of work tool 20 with the rotation of boom 13, such that work tool 20 rotates more quickly than boom 13. This may allow for finer operator control over an associated work tool 20 movement.

Controller 35 may determine a rotation ratio based on a manually controlled swinging motion of frame 11 and/or boom 13 and manually controlled rotation of work tool 20. For example, an operator may manually perform a swinging motion of machine 10 and rotation of work tool 20, and controller 35 may process and store the associated movements of work tool 20 and boom 13 in the memory of controller 35. The associated movements may be processed into a rotation ratio and stored on memory of controller 35 for subsequent uses. In this way, controller 35 may operate in a third mode of operation according to an operator programmed/determined rotation ratio. Alternatively, controller 35 may store any number of pre-determined rotation ratio's as individual settings from which the operator may choose.

Several benefits may be associated with the control strategy and hardware of the disclosed rotation control system. Specifically, during the semi-autonomous mode of operation, the disclosed rotation control system may lower operating costs; require reduced operator training, experience, and skill; reduce operator fatigue; enhance operator focus; and reduce collision likelihood.

It will be apparent to those skilled in the art that various modifications and variations can be made to the disclosed rotation control system. Other embodiments will be apparent to those skilled in the art from consideration of the specification and practice of the disclosed rotation control system. It is intended that the specification and examples be considered as exemplary only, with a true scope being indicated by the following claims and their equivalents.

What is claimed is:

1. A rotation control system for a material handling machine, comprising:

a boom;

a work tool coupled to the boom;

a swing motor configured to swing the boom and the work tool;

a work tool motor configured to rotate the work tool relative to the boom;

at least one input device configured to generate a first signal indicative of desired swinging of the boom and a second signal indicative of a desired rotation of the work tool; and a controller in communication with the at least one input device, the swing motor, and the work tool motor, the controller being configured to:

actuate the work tool motor based only on the second signal during a first mode of operation; and actuate the work tool motor based on swinging of the boom during a second mode of operation to semi-autonomously synchronize rotation of the work tool with the swinging of the boom, wherein the actuation of the work tool motor to synchronize rotation of the work tool with the swinging of the boom occurs during the swinging of the boom.

2. The rotation control system of claim 1, further including:

a hydraulic valve configured to regulate fluid flow to the swing motor; and a sensor configured to detect a position of the hydraulic valve, wherein the controller is configured to determine swinging of the boom based on a signal generated by the sensor.

3. The rotation control system of claim 1, further including an encoder configured to detect the swinging of the boom, wherein the controller is configured to determine swinging of the boom based on a signal from the encoder.

4. The rotation control system of claim 1, further including a sensor configured to detect operation of the swing motor, wherein the controller is configured to determine swinging of the boom based on a signal generated by the sensor.

5. The rotation control system of claim 1, wherein the controller is configured to cause the work tool to rotate in a direction opposite the swinging of the boom and at a rate of rotation equal to a rate of swinging of the boom during operation in the second mode.

6. The rotation control system of claim 1, wherein the controller is configured to actuate the work tool motor based on a rotation ratio during a third mode of operation.

7. The rotation control system of claim 6, further including an operator interface device in communication with the controller, and selectable to selectively cause operation in the first mode and second mode and third mode.

8. The rotation control system of claim 6, wherein the controller is configured to determine swinging of the boom based on a signal generated by the at least one input device.

9. The rotation control system of claim 8, wherein the controller is configured to determine the rotation ratio according to a prior manually controlled swinging of the boom and a prior manually controlled rotation of the work tool.

10. A method of controlling rotation of a material handling machine, comprising:

receiving, at a controller, a first signal indicative of swinging of a boom;

receiving, at the controller, a second signal indicative of a desire to move a work tool connected to the boom;

controlling rotation of the work tool based on only the second signal during a first mode of operation; and controlling, using the controller, rotation of the work tool based on the first signal during a second mode of operation to semi-autonomously synchronize rotation of the work tool with the swinging of the boom, wherein the rotation of the work tool to synchronize rotation of the work tool with the swinging of the boom occurs during the swinging of the boom.

11. The rotation control method of claim 10, wherein the first signal is associated with a manual input requesting swinging of the boom.

12. The rotation control method of claim 10 wherein the first signal is associated with a detected position of a hydraulic boom valve.

13. The rotation control method of claim 10, wherein the first signal is associated with a detected motion of a swing motor.

14. The rotation control method of claim 10, wherein the first signal is associated with a detected output of a rotary encoder associated with the boom.

15. The rotation control method of claim 10, wherein the rotation of the work tool during operation in the second mode is opposite the swinging of the boom and at a rate of rotation substantially equal to a rate of swinging of the boom.

16. The rotation control method of claim 10, wherein the rotation of the work tool during operation in a third mode is opposite the swinging of the boom and at a programmable rate of rotation relative to a rate of swinging of the boom.

17. A rotation control system for a material handling machine, comprising:

an undercarriage;

a frame rotatably connected to the undercarriage;

an operator station mounted to the frame;

a boom operably attached to the frame and configured to pivot vertically;

a swing motor configured to swing the frame and boom relative to the undercarriage;

a work tool rotatably coupled to the boom;

a work tool motor configured to rotate the work tool;

at least one input device configured to generate a first signal indicative of desired swinging of the frame and boom and a second signal indicative of a desired rotation of the work tool; and a controller in communication with the at least one input device, the swing motor, and the work tool motor, the controller being configured to:

actuate the work tool motor based only on the second signal during a first mode of operation;

actuate the work tool motor based on swinging of the boom during a second mode of operation to semi-autonomously synchronize rotation of the work tool with the swinging of the boom, wherein the actuation of the work tool motor to synchronize rotation of the work tool with the swinging of the boom occurs during the swinging of the boom; and actuate the work tool motor based on a rotation ratio during a third mode of operation.

18. The rotation control system of claim 17, wherein the work tool is a grapple or a bucket.

19. The rotation control system of claim 17, wherein the controller is further configured to:

cause the work tool to rotate relative to swinging of the boom according to an operator selectable rotation ratio.

20. The rotation control system of claim 19, further including an operator interface device in communication with the controller, and selectable to selectively cause operation in the first mode, the second mode, and the third mode.

* * * * *